US006299986B1

(12) United States Patent
Meelu

(10) Patent No.: US 6,299,986 B1
(45) Date of Patent: Oct. 9, 2001

(54) COATED SUPERALLOY ARTICLE AND A METHOD OF COATING A SUPERALLOY ARTICLE

(75) Inventor: Meehar C. Meelu, Birmingham (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/193,737

(22) Filed: Nov. 17, 1998

(30) Foreign Application Priority Data

Nov. 26, 1997 (GB) ..... 9724844

(51) Int. Cl.[7] ..... B32B 15/00

(52) U.S. Cl. ..... 428/615; 428/641; 428/652; 428/670; 428/678; 428/680; 416/241 R

(58) Field of Search ..... 428/623, 615, 428/633, 632, 641, 652, 668, 670, 678, 680; 416/241 R

(56) References Cited

U.S. PATENT DOCUMENTS

| | | | | |
|---|---|---|---|---|
| 5,035,958 | | 7/1991 | Jackson . | |
| 5,077,141 | | 12/1991 | Naik . | |
| 5,238,752 | | 8/1993 | Duderstadt . | |
| 5,270,123 | | 12/1993 | Walston . | |
| 5,395,584 | | 3/1995 | Berger . | |
| 5,427,866 | | 6/1995 | Nagaraj . | |
| 5,498,484 | | 3/1996 | Duderstadt . | |
| 5,500,252 | * | 3/1996 | Meelu | 427/376.3 |
| 5,547,770 | | 8/1996 | Meelu . | |
| 5,650,235 | | 7/1997 | McMordie . | |
| 5,922,409 | * | 7/1999 | McMordie et al. | 427/383.7 |

FOREIGN PATENT DOCUMENTS

| | | |
|---|---|---|
| 207874 A2 | 1/1987 | (EP) . |
| 545661 A2 | 6/1993 | (EP) . |
| 654542 A1 | 5/1994 | (EP) . |
| 718420 A1 | 6/1996 | (EP) . |
| 784104 A1 | 12/1996 | (EP) . |

* cited by examiner

*Primary Examiner*—Deborah Jones
*Assistant Examiner*—Bryant Young
(74) *Attorney, Agent, or Firm*—W. Warren Taltavull; Manelli, Denison & Selter PLLC

(57) ABSTRACT

A high rhenium-containing nickel superalloy article (10) has a multilayer coating (12) comprising a barrier coating (14) and an aluminide coating (16). The aluminide coating (16) is a corrosion and oxidation protective coating for the superalloy article (10). The barrier coating (14) comprises an alloy with a similar composition to the high rhenium-containing nickel superalloy article (10) but with less rhenium. The barrier coating (14) minimises diffusion of elements between the aluminide coating (16) and the superalloy article (10) to minimise the formation of topologically close packed phases at the interface between the superalloy article (10) and the multilayer coating (12). The barrier coating (12) preferably has some rhenium to minimise diffusion of rhenium from the superalloy article (10) to the barrier coating (14).

14 Claims, 2 Drawing Sheets

COATED SUPERALLOY ARTICLE AND A METHOD OF COATING A SUPERALLOY ARTICLE

FIELD OF THE INVENTION

The present invention relates to coated superalloy articles and to methods of coating superalloy articles, particularly rhenium-containing nickel and cobalt superalloy turbine blades or turbine vanes.

BACKGROUND OF THE INVENTION

It is known to produce aluminide-silicide protective coatings on superalloy turbine blades or turbine vanes to extend the service lives of the turbine blades or turbine vanes.

It is known to produce aluminide-silicide coatings on a superalloy article by depositing a silicon filled organic slurry on the superalloy article and then pack aluminising as described in U.S. Pat. No. 4,310,574. The aluminium carries the silicon from the slurry with it as it diffuses into the superalloy article. Another method of producing aluminide-silicide coatings is by depositing a slurry containing elemental aluminium and silicon metal powders on a superalloy article and then heating to above 760° C. to melt the aluminium and silicon in the slurry, such that they react with the superalloy and diffuse into the superalloy article as described in U.S. Pat. No. 3,248,251. A further method of producing aluminide-silicide coatings is by repeatedly applying the aluminium and silicon containing slurry and heat treating as described in U.S. Pat. No. 5,547,770. Another method of producing aluminide-silicide coatings is by applying a slurry of an eutectic aluminium-silicon or a slurry of elemental aluminium and silicon metal powders on a superalloy article and diffusion heat treating to form a surface layer of increased thickness and reduced silicon content, and a layering layer which comprises alternate interleaved layers of aluminide and silicide phases and a diffusion interface layer as described in published European patent application No. EP0619856A.

It is also known to produce platinum aluminide- silicide coatings on a superalloy article by coating the superalloy article with platinum, then heat treating to diffuse the platinum into the superalloy article and then simultaneously diffusing aluminium and silicon from the molten state into the platinum enriched superalloy article as described in published International patent application No. WO95/23243A. Another method of producing platinum aluminide-silicide coatings on a superalloy article is by coating the superalloy article with platinum, then heat treating to diffuse the platinum into the superalloy article, applying a silicon layer and then aluminising as described in published European patent application No. EP0654542A. It is also possible to diffuse the silicon into the superalloy article with the platinum as described in EP0654542A. A further method of producing platinum aluminide-silicide coatings on a superalloy article is by electrophoretically depositing platinum-silicon powder onto the superalloy article, heat treating to diffuse the platinum and silicon into the superalloy article, then electrophoretically depositing aluminium and chromium powder onto the superalloy article and then heat treating to diffuse the aluminium and chromium into the superalloy article as described in U.S. Pat. No. 5,057,196.

It is also known to produce aluminide coatings on a superalloy article by pack aluminising, out of contact vapour phase aluminising or slurry aluminising. It is also known to produce platinum aluminide coatings by depositing platinum onto the superalloy article and then pack aluminising, out of contact vapour phase aluminising or slurry aluminising.

It has been found that if aluminide, platinum aluminide, aluminide-silicide or platinum aluminide-silicide coatings are produced on high rhenium-containing superalloys, those containing more than 4 wt % rhenium, that topologically close packed phases (TCP phases) are formed within the superalloy substrate. These TCP phases are needle-like rhenium and tungsten rich phases which extend into the substrate. These TCP phases are undesirable because they reduce the useful load bearing area of the superalloy substrate. Also cracking may occur at the interface between the superalloy substrate and the TCP phase leading to decohesion of the aluminide, platinum aluminide, aluminide-silicide or platinum aluminide-silicide coating. Thus the application of these different aluminide coatings onto a high rhenium- containing superalloy article is not practical because these TCP phases increase the stress within the high rhenium-containing superalloy substrate leading to premature failure of the high rhenium-containing superalloy article.

It is further known to deposit MCrAlY or chromium coatings on superalloy turbine blades or turbine vanes to extend the service lives of the turbine blades or turbine vanes. The MCrAlY is generally deposited by plasma spraying or physical vapour deposition, followed by heat treating. The M is at least one of Ni, Co or Fe. The chromium coating is generally deposited by pack or vapour chromising.

It has been found that if a MCrAlY, or chromium, coating is produced on high rhenium-containing superalloys, those containing more than 4 wt % rhenium, that topologically close packed phases (TCP phases) are formed within the superalloy substrate.

SUMMARY OF THE INVENTION

The invention therefore seeks to provide a protective coating on a high rhenium-containing superalloy article with reduced formation, preferably no formation, of the TCP phases.

Accordingly the present invention provides a method of coating a high rhenium-containing superalloy article, the superalloy article comprising more than 4 wt % rhenium, comprising the steps of:

depositing a protective coating on the high rhenium-containing superalloy article, characterised by applying a barrier coating on the high rhenium-containing superalloy article before depositing the protective coating on the high rhenium-containing superalloy article, the barrier coating comprising an alloy having a lower rhenium content than the high rhenium-containing superalloy article to reduce the formation of TCP phases in the high rhenium-containing superalloy article.

The depositing of the protective coating may comprise depositing an aluminide coating or a MCrAlY coating.

The depositing of the protective coating may comprise depositing an aluminide-silicide coating, a platinum aluminide-silicide coating or a platinum aluminide coating.

The depositing of the protective coating may comprise simultaneously diffusing aluminium and silicon from the molten state into the barrier coating on the high rhenium-containing superalloy article.

The depositing of the protective coating may comprise depositing silicon and then depositing aluminium and diffusing the aluminium and silicon into the barrier coating on the high rhenium-containing superalloy article.

The depositing of the protective coating may comprise depositing platinum onto the barrier coating on the high rhenium-containing superalloy article, heat treating to diffuse the platinum into the barrier coating, simultaneously diffusing aluminium and silicon from the molten state into the barrier coating on the high rhenium-containing superalloy article.

The depositing of the protective coating may comprise depositing platinum onto the barrier coating on the high rhenium-containing superalloy article, heat treating to diffuse the platinum into the barrier coating, diffusing aluminium into the barrier coating on the high rhenium-containing superalloy article.

The platinum may be deposited by electroplating. The platinum may be heat treated at a temperature greater than 1000° C., preferably the platinum is heat treated at a temperature of 1120° C. for 1 to 2 hours to diffuse the platinum. The platinum may be deposited to a thickness between 5 and 15 microns.

The aluminising may be at a temperature in the range 850° C. to 950° C. The aluminium and silicon may be diffused into the barrier coating at a temperature in the range 750° C. to 1120° C.

The depositing of the barrier coating may comprise depositing an alloy having a similar composition to the superalloy article.

The depositing of the barrier coating may comprise depositing an alloy comprising less than 4 wt % rhenium. The alloy may comprise 9.3 to 10.0 wt % Co, 6.4–6.8 wt % Cr, 0.5–0.7 wt % Mo, 6.2–6.6 wt % W, 6.3–6.7 wt % Ta, 5.45–5.75 wt % Al, 0.8–1.2 wt % Ti, 0.07–0.12 wt % Hf, 2.8–3.2 wt % Re and balance Ni. The alloy may comprise 10 wt % Co, 9 wt % Cr, 10 wt % W, 2.5 wt % Ta, 5.5 wt % Al, 1.5 wt % Ti, 1.5 wt % Hf, 0.15 wt % C and balance Ni.

The superalloy substrate may comprise 1.5–9.0 wt % Co, 1.8–4.0 wt % Cr, 0.25–2.0 wt % Mo, 3.5–7.5 wt % W, 7.0–10.0 wt % Ta, 5.0–7.0 wt % Al, 0.1–1.2 wt % Ti, 0–0.15 wt % Hf, 5.0–7.0 wt % Re, 0–0.5 wt % Nb, 0–0.04 C and balance Ni.

The present invention also provides a coated high rhenium-containing superalloy article, the superalloy article comprising more than 4 wt % rhenium, a protective coating on the high rhenium-containing superalloy article, characterised by a barrier coating between the protective coating and the high rhenium-containing superalloy article, the barrier coating comprising an alloy having a lower rhenium content than the high rhenium-containing superalloy article to reduce the formation of TCP phases in the high rhenium-containing superalloy article.

The protective coating may comprise an aluminide coating or a MCrAlY coating.

The protective coating may comprise an aluminide-silicide coating, a platinum aluminide-silicide coating or a platinum aluminide coating.

Preferably the barrier coating comprises an alloy having a similar composition to the superalloy article.

The barrier coating may comprise an alloy having less than 4 wt % rhenium. The alloy may comprise 9.3 to 10.0 wt % Co, 6.4–6.8 wt % Cr, 0.5–0.7 wt % Mo, 6.2–6.6 wt % W, 6.3–6.7 wt % Ta, 5.45–5.75 wt % Al, 0.8–1.2 wt % Ti, 0.07–0.12 wt % Hf, 2.8–3.2 wt % Re and balance Ni. The alloy may comprise 10 wt % Co, 9 wt % Cr, 10 wt % W, 2.5 wt % Ta, 5.5 wt % Al, 1.5 wt % Ti, 1.5 wt % Hf, 0.15 wt % C and balance Ni.

The superalloy substrate may comprise 1.5–9.0 wt % Co, 1.8–4.0 wt % Cr, 0.25–2.0 wt % Mo, 3.5–7.5 wt % W, 7.0–10.0 wt % Ta, 5.0–7.0 wt % Al, 0.1–1.2 wt % Ti, 0–0.15 wt % Hf, 5.0–7.0 wt % Re, 0–0.5 wt % Nb, 0–0.04 C and balance Ni.

The high rhenium-containing superalloy article may be a nickel based superalloy article or a cobalt based superalloy article.

The high rhenium-containing superalloy article may be a single crystal superalloy article.

The high rhenium-containing superalloy article may be a turbine blade or a turbine vane.

BRIEF DESCRIPTION OF THE DRAWINGS

The present invention will be more fully described by way of example with reference to the accompanying drawings, in which.

DETAILED DESCRIPTION

Figure 1:
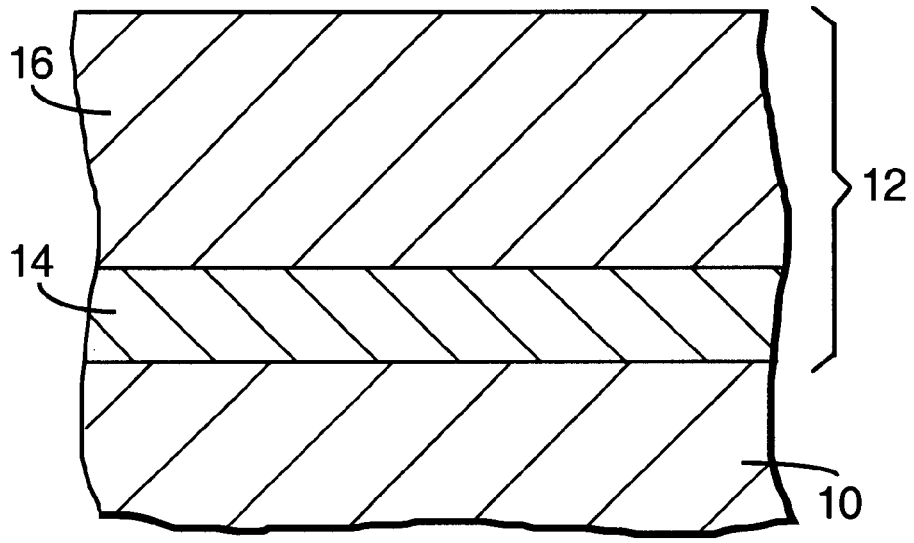
FIG. 1 is a cross-sectional view through a coated superalloy article according to the present invention.

A high rhenium-containing nickel superalloy article 10, for example a gas turbine engine turbine blade or turbine vane, has a multilayer coating 12 as shown in FIG. 1. The multilayer coating 12 comprises a barrier coating 14 on the high rhenium-containing nickel superalloy article 10 and an aluminide coating 16 on the barrier coating 14. The barrier coating 14 comprises an alloy having a similar composition to the high rhenium-containing superalloy article 10. However, the alloy of the barrier coating 14 has a lower rhenium content than the high rhenium-containing superalloy article 10. The aluminide coating 16 comprises a nickel aluminide.

It is believed that the provision of a barrier coating 14 having a similar composition to the high rhenium-containing superalloy article 10 between the high rhenium-containing superalloy article 10 and the aluminide coating 16 reduces the diffusion of elements between the aluminide coating 16 and the high rhenium-containing superalloy article 10. The barrier coating 14 and the high rhenium-containing superalloy article 10 have similar compositions, therefore there will be very little diffusion of elements between the two, particularly rhenium from the high rhenium-containing superalloy article 10 to the barrier coating 16. The barrier coating 14 has a lower content of rhenium and does not form TCP phases with the aluminide coating 16. The barrier coating 14 therefore minimises the formation of TCP phases in the high rhenium-containing superalloy article 10.

The barrier coating 14 is deposited on the high rhenium-containing superalloy article 10 by argon shrouded plasma spraying or by air plasma spraying. The barrier coating 14 is deposited to a thickness of about 125 micrometers. The aluminide coating 16 is produced on the barrier coating 14 by pack aluminising, out of contact vapour phase aluminising or by slurry aluminising. The aluminising process involves a heat treatment at a temperature in the range 750° C. to 1200° C., preferably 800° C. to 950° C. The aluminium diffuses into the barrier coating 14 to a depth of about 75 micrometers to form the aluminide coating 16. Thus there remains a barrier coating 14 of thickness about 50 microns.

Figure 2:
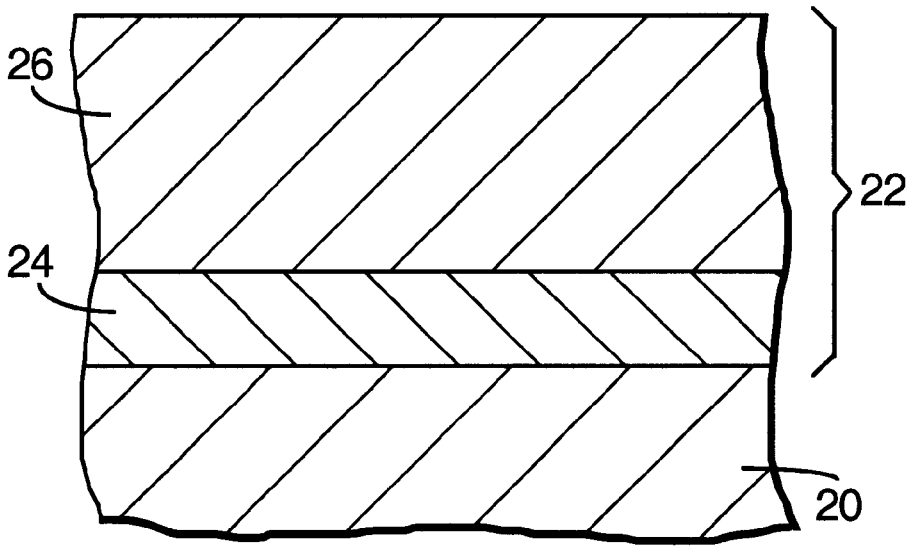
FIG. 2 is a cross-sectional view through a further coated superalloy article according to the present invention.

Another high rhenium-containing nickel superalloy article 20, for example a gas turbine engine turbine blade or turbine vane, has a multilayer coating 22 as shown in FIG. 2. The multilayer coating 22 comprises a barrier coating 24 on the high rhenium-containing nickel superalloy article 20 and a platinum aluminide coating 26 on the barrier coating 24. The barrier coating 24 comprises an alloy having a similar composition to the high rhenium-containing superalloy article 20. However, the alloy of the barrier coating 24 has a lower rhenium content than the high rhenium-containing superalloy article 20.

It is believed that the provision of a barrier coating 24 having a similar composition to the high rhenium-containing superalloy article 20 between the high rhenium-containing superalloy article 20 and the platinum aluminide coating 26 reduces the diffusion of elements between the platinum aluminide coating 26 and the high rhenium-containing superalloy article 20. The barrier coating 24 and the high rhenium-containing superalloy article 20 have similar compositions, therefore there will be very little diffusion of elements between the two, particularly rhenium from the high rhenium-containing superalloy article 20 to the barrier coating 26. The barrier coating 24 has a lower content of rhenium and does not form TCP phases with the aluminize coating 26. The barrier coating 24 therefore minimises the formation of TCP phases in the high rhenium-containing superalloy article 20.

The barrier coating 24 is deposited on the high rhenium-containing superalloy article 20 by argon shrouded plasma spraying or by air plasma spraying. The barrier coating 24 is deposited to a thickness of about 125 micrometers. The platinum aluminide coating 26 is produced on the barrier coating 24 by depositing a platinum layer on the barrier coating 24 and then the platinum is heat treated to diffuse the platinum into the barrier coating 24. The platinum is deposited to a thickness of 5 to 15 micrometers by electroplating, physical vapour deposition or other suitable means. The platinum is heat treated at a temperature greater than 1000° C., for example 1 hour at 1120° C. followed by gas fan quenching and ageing for 24 hours at 845° C. The platinum is then aluminised by pack aluminising, out of contact vapour phase aluminising or by slurry aluminising. The aluminizing process involves a heat treatment at a temperature in the range 750° C. to 1200° C., preferably 800° C. to 950° C. The aluminium diffuses into the platinum in the barrier coating 24 to a depth of about 75 micrometers to form the platinum aluminide coating 26. Thus there remains a barrier coating 24 of thickness about 50 micrometers.

Figure 3:
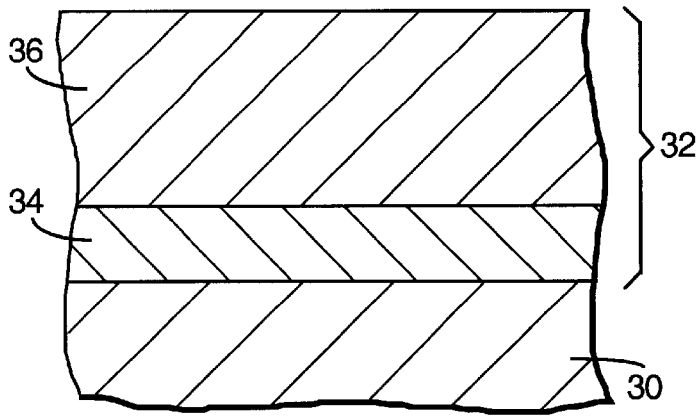
FIG. 3 is a cross-sectional view through another coated superalloy article according to the present invention.

Another high rhenium-containing nickel superalloy article 30, for example a gas turbine engine turbine blade or turbine vane, has a multilayer coating 32 as shown in FIG. 3. The multilayer coating 32 comprises a barrier coating 34 on the high rhenium-containing nickel superalloy article 30 and an aluminide-silicide coating 36 on the barrier coating 34. The barrier coating 34 comprises an alloy having a similar composition to the high rhenium-containing superalloy article 30. However, the alloy of the barrier coating 34 has a lower rhenium content than the high rhenium-containing superalloy article 30.

It is believed that the provision of a barrier coating 34 having a similar composition to the high rhenium-containing superalloy article 30 between the high rhenium-containing superalloy article 30 and the aluminide-silicide coating 36 reduces the diffusion of elements between the aluminide-silicide coating 36 and the high rhenium-containing superalloy article 30. The barrier coating 34 and the high rhenium-containing superalloy article 30 have similar compositions, therefore there will be very little diffusion of elements between the two, particularly rhenium from the high rhenium-containing superalloy article 30 to the barrier coating 34. The barrier coating 34 has a lower content of rhenium and does not form TCP phases with the aluminide-silicide coating 36. The barrier coating 34 therefore minimises the formation of TCP phases in the high rhenium-containing superalloy article 30.

The barrier coating 34 is deposited on the high rhenium-containing superalloy article 30 by argon shrouded plasma spraying or by air plasma spraying. The barrier coating 34 is deposited to a thickness of about 125 micrometers. The aluminide-silicide coating 36 is produced on the barrier coating 34 by depositing aluminium and silicon onto the barrier coating 34 and heat treating to diffuse them into the barrier coating 34. The aluminium and silicon are deposited using a slurry comprising aluminium and silicon powders dispersed in a suitable binder and the slurry is cured to a solid matrix which holds the metal pigments in contact with the metal surface during the heat treatment. The aluminium and silicon are heat treated at a temperature in the range 750° C. to 850° C. to simultaneously diffuse them from the molten state as described in U.S. Pat. No. 3,248,251 which is incorporated herein by reference. The silicon may be deposited first by spraying a silicon filled slurry and then pack aluminising. The aluminium diffusing into the barrier coating 34 carries the silicon with it as described in U.S. Pat. No. 4,310,574 which is also incorporated herein by reference. Other suitable methods of depositing and diffusing the aluminium and silicon into the barrier coating 34 may be used. The aluminium and silicon diffuses into the barrier coating 34 to a depth of about 75 micrometers to form the aluminide-silicide coating 36. Thus there remains a barrier coating 34 of thickness about 50 micrometers.

It may be beneficial to repeat the deposition of the aluminium and silicon and the diffusion heat treatment steps to provide a plurality of bands rich in silicon and a plurality of bands rich in aluminium with the silicon rich bands and the aluminium rich bands arranged alternately through the depth of the aluminide-silicide coating 36. This technique is described more fully in published International Patent application No. WO93/23247.

Figure 4:
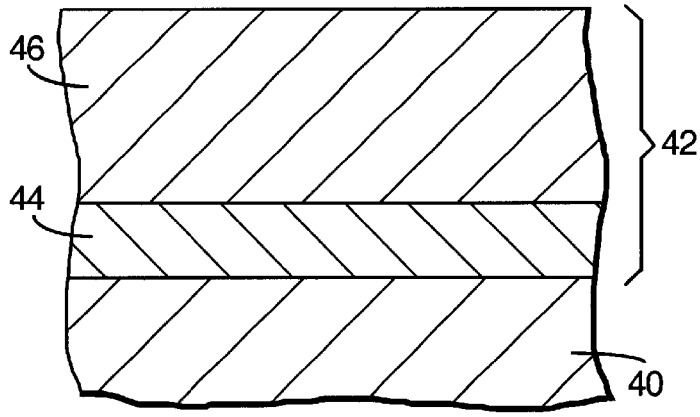
FIG. 4 is a cross-sectional view through an additional coated superalloy article according to the present invention.

Another high rhenium-containing nickel superalloy article 40, for example a gas turbine engine turbine blade or turbine vane, has a multilayer coating 42 as shown in FIG. 4. The multilayer coating 42 comprises a barrier coating 44 on the high rhenium-containing nickel superalloy article 40 and a platinum aluminide-silicide coating 46 on the barrier coating 44. The barrier coating 44 comprises an alloy having a similar composition to the high rhenium-containing superalloy article 40. However, the alloy of the barrier coating 44 has a lower rhenium content than the high rhenium-containing superalloy article 40.

It is believed that the provision of a barrier coating 44 having a similar composition to the high rhenium-containing superalloy article 40 between the high rhenium-containing superalloy article 40 and the platinum aluminide-silicide coating 46 reduces the diffusion of elements between the platinum aluminide-silicide coating 46 and the high rhenium-containing superalloy article 40. The barrier coating 44 and the high rhenium-containing superalloy article 40 have similar compositions, therefore there will be very little diffusion of elements between the two, particularly rhenium from the high rhenium-containing superalloy article 40 to the barrier coating 44. The barrier coating 44 has a lower content of rhenium and does not form TCP phases with the platinum aluminide-silicide coating 46. The barrier coating 44 therefore minimises the formation of TCP phases in the high rhenium-containing superalloy article 40.

The barrier coating 44 is deposited on the high rhenium-containing superalloy article 40 by argon shrouded plasma spraying or by air plasma spraying. The barrier coating 44 is deposited to a thickness of about 125 micrometers.

The platinum aluminide-silicide coating 46 is produced on the barrier coating 44 by firstly depositing a platinum layer on the barrier coating 44 and then the platinum is heat treated to diffuse the platinum into the barrier coating 44. The platinum is deposited to a thickness of 5 to 15 micrometers by electroplating, physical vapour deposition or other suitable means. The platinum is heat treated at a temperature greater than 1000° C., for example 1 hour at 1120° C. followed by gas fan quenching and ageing for 24 hours at 845° C.

Then aluminium and silicon are deposited onto the platinum in the barrier coating 44 and there is a heat treatment to diffuse them into the platinum in the barrier coating 44. The aluminium and silicon are deposited using a slurry comprising aluminium and silicon powders dispersed in a suitable binder and the slurry is cured to a solid matrix which holds the metal pigments in contact with the metal surface during the heat treatment. The aluminium and silicon are heat treated at a temperature in the range 750° C. to 850° C. to simultaneously diffuse them from the molten state as described in U.S. Pat. No. 3,248,251 which is incorporated herein by reference. The silicon may be deposited first by spraying a silicon filled slurry and then pack aluminising. The aluminium diffusing into the platinum in the barrier coating 44 carries the silicon with it as described in U.S. Pat. No. 4,310,574 which is also incorporated herein by reference. Other suitable methods of depositing and diffusing the aluminium and silicon into the platinum in the barrier coating 44 may be used. The platinum, aluminium and silicon diffuses into the barrier coating 44 to a depth of about 75 micrometers to form the platinum aluminide-silicide coating 46. Thus there remains a barrier coating 44 of thickness about 50 micrometers.

It may be beneficial to repeat the deposition of the aluminium and silicon and the diffusion heat treatment steps to provide a plurality of bands rich in silicon and a plurality of bands rich in aluminium with the silicon rich bands and the aluminium rich bands arranged alternately through the depth of the aluminide-silicide coating 36. This technique is described more fully in published International Patent application No. WO93/23247.

Figure 5:
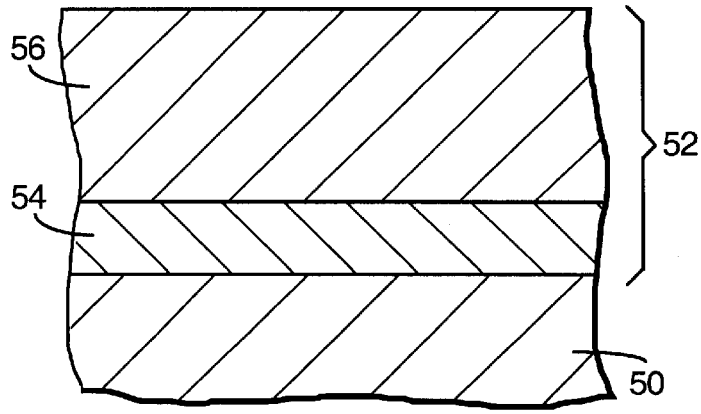
FIG. 5 is a cross-sectional view through a further coated superalloy article according to the present invention.

A further high rhenium-containing nickel superalloy article 50, for example a gas turbine engine turbine blade or turbine vane, has a multilayer coating 52 as shown in FIG. 5. The multilayer coating 52 comprises a barrier coating 54 on the high rhenium-containing nickel superalloy article 50 and a MCrAlY, or chromium, coating 56 on the barrier coating 54. The barrier coating 54 comprises an alloy having a similar composition to the high rhenium-containing superalloy article 50. However, the alloy of the barrier coating 54 has a lower rhenium content than the high rhenium-containing superalloy article 50.

It is believed that the provision of a barrier coating 54 having a similar composition to the high rhenium-containing superalloy article 50 between the high rhenium-containing superalloy article 50 and the MCrAlY, or chromium, coating 56 reduces the diffusion of elements between the MCrAlY, or chromium, coating 56 and the high rhenium-containing superalloy article 50. The barrier coating 54 and the high rhenium-containing superalloy article 50 have similar compositions, therefore there will be very little diffusion of elements between the two, particularly rhenium from the high rhenium-containing superalloy article 50 to the barrier coating 54. The barrier coating 54 has a lower content of rhenium and does not form TCP phases with the MCrAlY, or chromium, coating 56. The barrier coating 54 therefore minimises the formation of TCP phases in the high rhenium-containing superalloy article 50.

The barrier coating 54 is deposited on the high rhenium-containing superalloy article 50 by argon shrouded plasma spraying or by air plasma spraying. The barrier coating 54 is deposited to a thickness of about 125 micrometers.

The MCrAlY coating 56 is deposited on the barrier coating 54 by argon shrouded plasma spraying, air plasma spraying or physical vapour deposition and is heat treated to diffuse the MCrAlY into the barrier coating 54. The MCrAlY is deposited to a thickness of about 75 micrometers. The MCrAlY is heat treated at a temperature greater than 1000° C., for example 1 hour at 1120° C. followed by gas fan quenching and ageing for 24 hours at 845° C.

The chromium coating 56 is deposited on the barrier coating 54 by vapour or pack chromising at 1100° C. for 5 hours to diffuse the chromium into the barrier coating 54. The chromium diffuses into the barrier coating to a depth of about 75 micrometers to form the chromium coating 56.

In tests we have deposited an aluminide-silicide coating containing a plurality of bands rich in silicon and a plurality of bands rich in aluminium with the silicon rich bands and aluminium rich bands arranged alternately through the depth of the aluminide-silicide coating onto a high rhenium-containing nickel based single crystal superalloy article, for example CMSX10, and found that TCP phases are formed at the interface with the superalloy article. CMSX10 is produced by the Cannon-Muskegon Corporation of 2875 Lincoln Street, Muskegon, Mich. MI 49433-0506, USA. CMSX10 has a nominal composition of 1.5–9.0 wt % Co, 1.8–4.0 wt % Cr, 0.25–2.0 wt % Mo, 3.5–7.5 wt % W, 7.0–10.0 wt % Ta, 5.0–7.0 wt % Al, 0.1–1.2 wt % Ti, 0–0.15 wt % Hf, 5.0–7.0 wt % Re, 0–0.5 wt % Nb, 0–0.04 C and balance Ni.

In tests we have deposited a platinum aluminide-silicide coating onto a high rhenium-containing nickel based single crystal superalloy article, for example CMSX10, and found that TCP phases are formed at the interface with the superalloy article.

In tests we have deposited a platinum aluminide coating onto a high rhenium-containing nickel based single crystal superalloy article, for example CMSX10, and found that TCP phases are formed at the interface with the superalloy article.

In tests we have deposited a MCrAlY coating onto a high rhenium-containing nickel based single crystal superalloy article, for example CMSX10, and found that TCP phases are formed at the interface with the superalloy article.

In tests we have deposited a chromium coating onto a high rhenium-containing nickel based single crystal superalloy article, for example CMSX10, and found that TCP phases are formed at the interface with the superalloy article.

In tests we have deposited a platinum aluminide-silicide coating onto a nickel based superalloy article containing no rhenium, for example MAR-M002, and found that no TCP phases are formed at the interface with the superalloy article. MAR-M002 is produced by the Martin-Marietta Corporation of Bethesda, Md. USA. MAR-M002 has a nominal composition of 10 wt % Co, 9 wt % Cr, 10 wt % W, 2.5 wt % Ta, 5.5 wt % Al, 1.5 wt % Ti, 1.5 wt % Hf, 0.15 wt % C and balance Ni.

In tests we have deposited a platinum aluminide coating onto MAR-M002 and found that no TCP phases are formed at the interface with the superalloy article.

In tests we have deposited an aluminide-silicide coating onto MAR-M002 and found that no TCP phases are formed at the interface with the superalloy article.

In tests we have deposited a MCrAlY coating onto MAR-M002 and found that no TCP phases are formed at the interface with the superalloy article.

In tests we have deposited an aluminide-silicide coating containing a plurality of bands rich in silicon and a plurality of bands rich in aluminium with the silicon rich bands and aluminium rich bands arranged alternately through the depth of the aluminide-silicide coating onto a low rhenium-containing nickel based single crystal superalloy article, for example CMSX4, and found that no TCP phases are formed at the interface with the superalloy article. CMSX4 is produced by the Cannon-Muskegon Corporation of 2875 Lincoln Street, Muskegon, Mich. MI 49433-0506, USA. CMSX4 has a nominal composition of 9.3 to 10.0 wt % Co, 6.4–6.8 wt % Cr, 0.5–0.7 wt % Mo, 6.2–6.6 wt % W. 6.3–6.7 wt % Ta, 5.45–5.75 wt % Al, 0.8–1.2 wt % Ti, 0.07–0.12 wt % Hf, 2.8–3.2 wt % Re and balance Ni.

In tests we have deposited a platinum aluminide-silicide coating onto a low rhenium-containing nickel based single crystal superalloy article, for example CMSX4, and found that no TCP phases are formed at the interface with the superalloy article.

In tests we have deposited a platinum aluminide coating onto a low rhenium-containing nickel based single crystal superalloy article, for example CMSX4, and found that no TCP phases are formed at the interface with the superalloy article.

In tests we have deposited a MCrAlY coating onto a low rhenium-containing nickel based single crystal superalloy article, for example CMSX4, and found that no TCP phases are formed at the interface with the superalloy article.

In tests we have deposited a chromium coating onto a low rhenium-containing nickel based single crystal superalloy article, for example CMSX4, and found that no TCP phases are formed at the interface with the superalloy article.

The invention proposes that the barrier coating comprises the use of low rhenium-containing alloys with similar composition to the high rhenium-containing superalloy article. The invention also proposes the use of alloys containing no rhenium but with similar compositions to the high rhenium-containing superalloy article. The use of low rhenium-containing alloys is preferred because this will minimise any diffusion of rhenium from the superalloy article into the barrier coating.

Thus for example the high rhenium-containing superalloy article in FIGS. 1 to 5 comprises CMSX1, the barrier coating preferably comprises CMSX4, but may comprise MAR-M002. It is clear to a person skilled in the art that other suitable low-rhenium containing alloys, or no rhenium-containing alloys, may be used. It is preferred that the alloy of the barrier coating has a similar composition to the superalloy article to minimise interdiffusion of elements between the barrier coating and the superalloy article to minimise the possibility of formation of TCP phases. It is also clear that other high rhenium-containing superalloy articles may be used and that the barrier coating is selected accordingly.

The high rhenium-containing superalloy articles are preferably high rhenium-containing nickel based superalloy articles, and are preferably high rhenium-containing nickel based single crystal superalloy articles, but they may be any high rhenium-containing superalloy article which suffers from the formation of TCP phases. The superalloy article may be a gas turbine turbine blade or a turbine vane or any other superalloy article which requires an aluminide coating.

The invention is also applicable to other aluminising processes, chromising processes and other protective coatings where TCP phases are formed.

The high rhenium-containing superalloy articles comprise more than 4 wt % rhenium. The low rhenium-containing alloys comprise less than 4 wt % rhenium.

It is essential that the thickness of the barrier coating as deposited is greater than the depth of diffusion of the aluminide coating so that there is always a portion of the barrier coating without any aluminide coating between the aluminide coating and the high rhenium-containing superalloy article.

Other suitable barrier coating alloys include IN-792 and IN-738. IN-738 typically comprises 16 wt % Cr, 8.5 wt % Co, 3.45 wt % Al, 3.45 wt % Ti, 2.6 wt % W, 1.7 wt % Mo, 1.0 wt % Ta, 0.8 wt % Nb and the balance is Ni plus incidental impurities. IN-792 typically comprises 12.5 wt % Cr, 9 wt % Co, 4.2 wt % W, 4.2 wt % Ta, 4 wt % Ti, 3.4 wt % Al, 1.9 wt % Mo and the balance is Ni plus incidental impurities. These barrier coating alloys do not form TCP phases when aluminised, platinum aluminised, silicon aluminised etc.

In tests we have deposited MCrAlY coatings, aluminide coatings, platinum aluminide coatings, aluminide-silicide coatings on IN-792 and IN-738 and no TCP phases have been formed.

It is also possible to use barrier coatings comprising MCrAlY alloys which are tailored to minimise the possibility of the formation of TCP phases in the superalloy article. The MCrAlY alloys are tailored by adjusting their chromium content such that the MCrAlY comprises up to 16 wt % Cr and up to 10 wt % Al.

It has also been observed that when the high rhenium-containing nickel superalloy articles have been aluminised and the TCP phases form, there is an interphase material between the needles of the TCP phases. The interphase material comprises a nickel alloy which is very stable and which exists in close proximity to the TCP phases. The interphase material may be analysed to determine the composition of the alloy and a barrier coating of this composition may be deposited on to the superalloy article.

The barrier coating comprises any alloy which comprises less than 4 wt % rhenium, up to 10 wt % aluminium and up to 16 wt % chromium so that the barrier coating itself does not form TCP phases in the superalloy article. Preferably the barrier coating comprises less than 10 wt % aluminium and less than 10 wt % chromium so that the barrier coating itself does not form TCP phases in the superalloy article.

It is believed that high aluminium content protective coatings, for example aluminide coatings, have an indirect effect on the formation of TCP phases. The aluminium causes the nickel in the superalloy article to diffuse to the aluminium to form nickel aluminide intermetallics. However, the heavy metal elements, including rhenium, are not absorbed into the nickel aluminide but instead segregate to form intermetallics which lead to the formation of the TCP phases. It is believed that the high chromium content protective coatings, for example MCrAlY and chromium coatings, have a direct effect on the formation of TCP phases. The chromium forms intermetallics with the heavy metal elements which lead to the formation of the TCP phases.

I claim:

1. A coated high rhenium-containing superalloy article, wherein the superalloy article comprises more than 4 wt. % rhenium, the barrier coating comprisies an alloy having a lower rhenium content than the high rhenium-containing superalloy article to reduce the formation of topologically closely packed phases in the high rhenium-containing superalloy article and a protective coating on the barrier coating, wherein the barrier coating alloy has a composition that reduces the diffusion of elements between the superalloy article and the barrier coating and eliminates the formation of topologically closely packed phases with the protective coating.

2. A coated superalloy article as claimed in claim 1 wherein the protective coating comprises a MCrAlY coating, where M is at least one of Ni, Co and Fe.

3. A coated superalloy article as claimed in claim 1 wherein the protective coating comprises an aluminide coating.

4. A coated superalloy article as claimed in claim 3 wherein the aluminide coating comprises an aluminide-silicide coating, a platinum aluminide-silicide coating or a platinum aluminide coating.

5. A coated superalloy article as claimed in claim 1 wherein the alloy has a similar composition to the superalloy article except for the amount of rhenium in the article.

6. A coated superalloy article as claimed in claim 1 wherein the alloy comprises less than 4 wt % rhenium.

7. A coated superalloy article as claimed in claim 6 wherein the alloy comprsies up to 16 wt % chromium and up to 10 wt % aluminium.

8. A coated superalloy article as claimed in claim 7 wherein the alloy comprises 9.3 to 10.0 wt % Co, 6.4–6.8 wt % Cr, 0.5–0.7 wt % Mo, 6.2–6.6 wt % W, 6.3–6.7 wt % Ta, 5.45–5.75 wt % Al, 0.8–1.2 wt % Ti, 0.07–0.12 wt % Hf, 2.8–3.2 wt % Re and balance Ni.

9. A coated superalloy article as claimed in claim 7 wherein the alloy comprises 10 wt % Co, 9 wt % Cr, 10 wt % W, 2.5 wt % Ta, 5.5 wt % Al, 1.5 wt % Ti, 1.5 wt % Hf, 0.15 wt % C and balance Ni.

10. A coated superalloy substrate as claimed in claim 1 wherein the high rhenium-containing superalloy article is a nickel based superalloy article or a cobalt based superalloy article.

11. A coated superalloy substrate as claimed in claim 10 wherein the high rhenium-containing superalloy article is a single crystal superalloy article.

12. A coated superalloy article as claimed in claim 1 wherein the superalloy substrate comprises 1.5–9.0 wt % Co, 1.8–4.0 wt % Cr, 0.25–2.0 wt % Mo, 3.5–7.5 wt % W, 7.0–10.0 wt % Ta, 5.0–7.0 wt % Al, 0.1–1.2 wt % Ti, 0–0.15 wt % Hf, 5.0–7.0 wt % Re, 0–0.5 wt % Nb, 0–0.04 C and balance Ni.

13. A coated superalloy substrate as claimed in claim 1 wherein the high rhenium-containing superalloy article is a turbine blade or a turbine vane.

14. The invention as claimed in claim 1 wherein said protective coating is a chromium coating.

* * * * *